United States Patent [19]

Fineberg

[11] Patent Number: 4,681,160

[45] Date of Patent: Jul. 21, 1987

[54] APPARATUS FOR SECURING A MEASUREMENT-WHILE-DRILLING (MWD) INSTRUMENT WITHIN A PIPE

[75] Inventor: Douglas H. Fineberg, Houston, Tex.

[73] Assignee: Dresser Industries, Inc., Dallas, Tex.

[21] Appl. No.: 797,275

[22] Filed: Nov. 12, 1985

[51] Int. Cl.[4] ..... E21B 23/00; E21B 23/04

[52] U.S. Cl. ..... 166/212; 166/217; 175/325; 29/700

[58] Field of Search ..... 175/325; 166/241, 216, 166/217, 212; 29/700

[56] References Cited

U.S. PATENT DOCUMENTS 3,011,558 12/1961 Conrad ..... 166/212
3,223,170 12/1965 Mott ..... 166/217 X
3,456,723 7/1969 Current et al. ..... 166/217 X
4,141,413 2/1979 Morris et al. ..... 166/212 X
4,423,777 1/1984 Mullins et al. ..... 166/212 X

*Primary Examiner*—Howard N. Goldberg
*Assistant Examiner*—Ronald S. Wallace

[57] ABSTRACT

A system for securing a measurement-while-drilling (MWD) instrument in a generally centralized position within a protective drill collar. The system includes a pressure responsive slidable contact pad member in combination with a plurality of fixed contact pad members. As the instrument is subjected to an increase in pressure, above atmospheric, a slidable contact pad member moves longitudinally along an inclined angle face of a base member into contact with the inner wall of the drill collar to thereby centralize and secure the instrument within the drill collar.

8 Claims, 6 Drawing Figures

APPARATUS FOR SECURING A MEASUREMENT-WHILE-DRILLING (MWD) INSTRUMENT WITHIN A PIPE

BACKGROUND OF THE INVENTION

This invention relates generally to measurement-while-drilling (MWD) systems and, more particularly, to methods and apparatus for securing a measurement while drilling instrument within a drill collar.

It has long been recognized in the exploration for hydrocarbons that obtaining of data from a subsurface instrument during the drilling operation would provide valuable information to the drilling operator. Information such as, for example, weight on bit, rotation rate, inclination and bearing of the borehole, fluid pressure, temperature and certain lithological measurements of the formations are of interest to the drilling operator during the drilling operation. A variety of measurement-while-drilling systems are used to measure such parameters and to transmit the data to the surface of the earth utilizing one of several transmission techniques common in the art.

In a typical embodiment a measurement-while-drilling instrument is mounted within a section of drill collar and affixed within the drill string at a location above the drill bit. The vibrational environment caused by the drilling operation is particularly harmful to electronic and mechanical systems associated with the measuring and transmission to the surface of the data. As the drilling process proceeds the drill bit will rise and fall with rotation. This is one of several factors which can cause the bit load to vary, further causing the bit to produce irregular demands on power, thus rendering the drill bit as a cause of drill strings vibrations. Additionally, the rotation of the drill string causes gyrations which are coupled to the drill bit as load and torque variations. Thus, the drill string itself induces irregular power into the bit and thereby causes drill string vibrations. Such vibrations can result in damage to the mechanical and electronic components of the measurement-while-drilling system.

Accordingly, the present invention overcomes these difficulties by providing method and apparatus for reliably securing a measurement-while-drilling-instrument within a drill collar to minimize the potential of damge which could be caused by vibration and/or shock.

SUMMARY OF THE INVENTION

The present invention relates to method and apparatus for centralizing a measurement-while-drilling-instrument within a protective drill collar and for restraining the instrument from movement within the drill collar. The system consists of an elongated body member, that can be installed within the measurement while drilling instrument assembly, having a plurality of fixed contact pad members mounted thereon. In addition, a pressure actuated, slidable contact pad member is mounted on the body member. This pad member includes a base member having an inclined plane inner surface and a truncated generally wedged shaped slidable contact pad member retained therein. At least one cylindrical chamber is formed within the sliding contact pad member into which extends one end of a piston, the other end of which is coupled to the base member. As the instrument is subjected to an increase in pressure above atmospheric pressure, the sliding contact pad member will move longitudinally along the piston and a guide shaft, up the inclined plane and into integral contact with the inside wall of the drill collar. A longitudinal force and the absence of external pressure, above ambient on the elongated body member will cause the contact pad to reposition allowing removal of the instrument from the drill collar.

Thus, the present invention includes a system for holding a measurement-while-drilling-instrument in place within a protective drill collar in a manner to minimize possible damage to the instrument due to shock and/or vibration. In addition the system is easily set by pressure and provides for easy removal of the instrument from the drill collar.

These and other features and advantages of the present invention will be more readily understood by those skilled in the art from a reading of the following detailed description with reference to the accompanying drawings.

DETAILED DESCRIPTION OF THE PREFERRED EMBODIMENT

Figure 1:
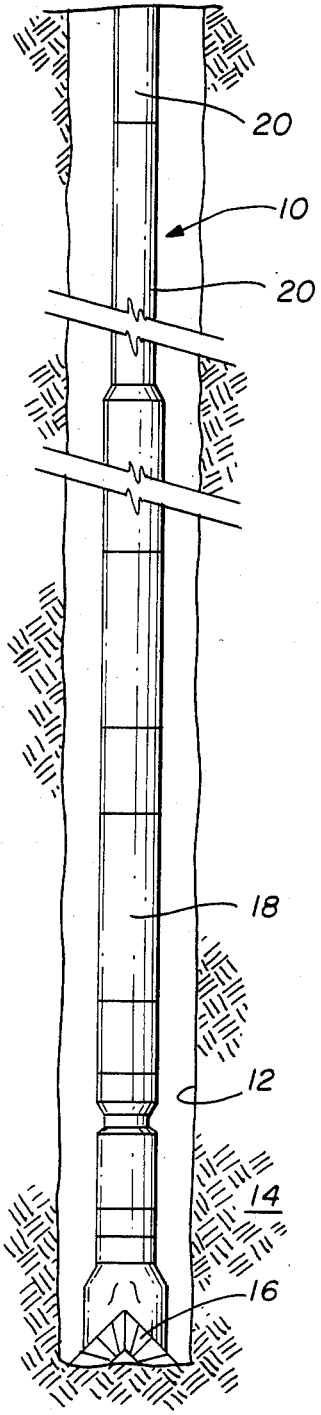
FIG. 1 is a schematic elevational view of a drill string incorporating a measurement-while-drilling-system in accordance with the present invention.

Referring now to the drawings, FIG. 1 illustrates a m easurement-while-drilling operation. Drill string 10 is suspended in borehole 12 penetrating subsurface earth formations 14. Drill string 10 extends to the earth's surface, where it is connected in a manner common in the art. Drill string 10 includes drill bit 16 which may be rotated in borehole 12 by rotating drill string 10 or by use of a mud motor, or the like, to penetrate into earth formations 14. Positioned above drill bit 16 is drill collar section 18. Housed within drill collar 18 is a measurement-while-drilling-instrument containing the required power generating system, measurement electronics circuitry and data telemetry system. The measurement-while-drilling-apparatus is secured in a generally centralized position within drill collar section 18 by means of a restraining system described in greater detail herein. Drill string 10 will include sections of drill pipe 20 that will complete drill string 10 to the earth's surface, with such sections normally being thirty (30) to forty-five (45) feet in length.

Figure 2:
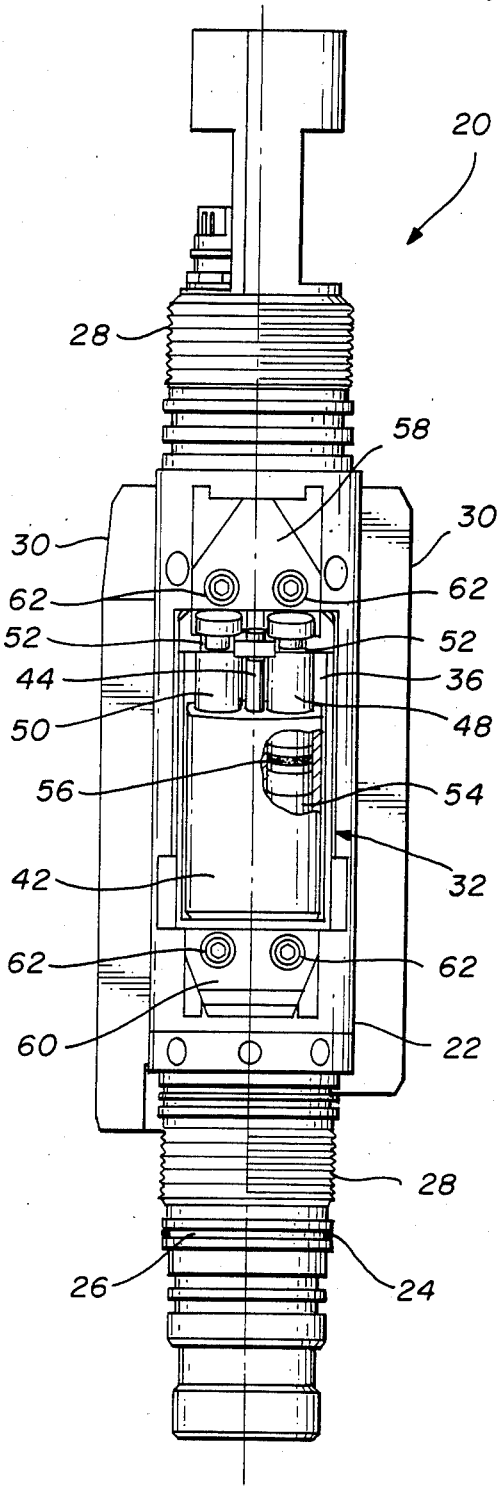
FIG. 2 is a schematic view, partially cut away, of the centralizing/retaining apparatus of the present invention.
Figure 3:
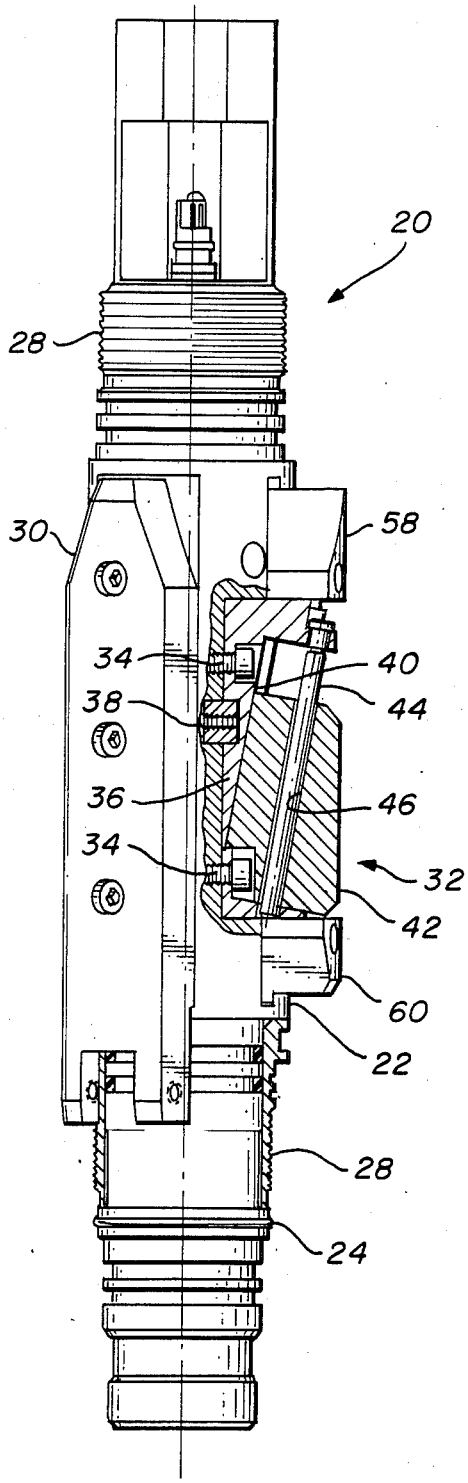
FIG. 3 is a longitudinal view, partially in cross section of the apparatus of FIG. 2.

Referring now to FIGS. 2 and 3, there is illustrated the centralizing/retaining apparatus 20 of the present invention. It should be recognized that two or more of such devices are longitudinally spaced in the measurement while drilling instrument assembly to centralize the instrument within drill collar section 18 and to rigidly secure the instrument therein. Centralizing/retaining apparatus 20 includes an elongated body member 22 having fluid seals, such as, in the form of o-rings 24 retained within a circumferential groove 26, at both ends thereof. Centralizer/retaining apparatus 20 is coupled into the measurement-while-drilling-instrument string by threaded collars 28 at both ends thereof. Mechanically mounted to body member 22 are a plurality of fixed contact pad members, illustrated by pad member 30. In the preferred embodiment there are two fixed pad members 30 mounted on body member 22 at 120° spacing therebetween.

Figure 4A:
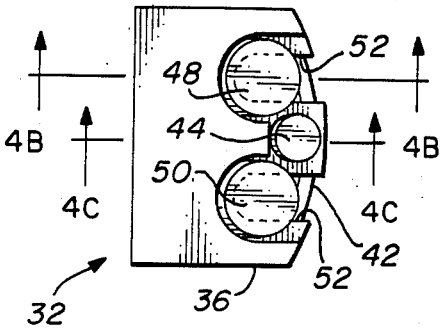
FIG. 4A is a lateral view of the contacting pad member of the centralizing/retaining apparatus of FIGS. 2 and 3.
Figure 4B:
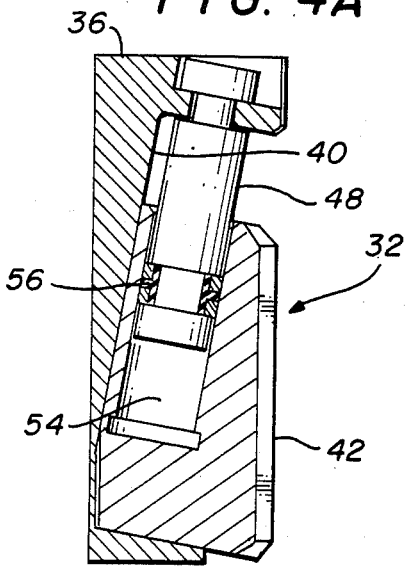
FIGS. 4B and 4C are longitudinal cross-sections of the contacting pad member of FIG. 4.
Figure 4C:
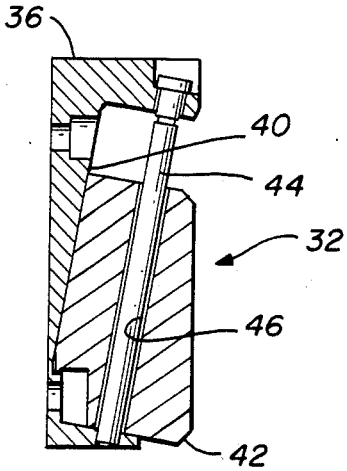

A third pressure actuated contact pad member 32 is mounted by suitable means, such as screws 34, to body member 22 equidistant from pad members 30. For a more complete illustration of pad member 32 several cross-sectional views are illustrated in FIG. 4. Pad member 32 includes base member 36 adapted for mounting to body member 22 by screws 34 and pin 38.

Base member 36 is a generally U-shaped configuration, as illustrated in the figures, and is constructed with an inclined plane surface 40. Slidably retained within base member 36 is a truncated generally wedge shaped contact pad member 42. The curvature of the outer face of pad member 42 will approximately correspond to the curvature of the inside of drill collar 18. Pad member 42 is slidable retained within base member 36 by retaining guide shaft 44, retained at each end thereof in base member 36 and passing through bore 46 in pad member 42, allowing pad member 42 to slide longitudinally along guide shaft 44 and inclined surface 40.

First and second piston members, 48 and 50 respectively, have a first end thereof mounted within base member 36. In the illustrated embodiment pistons 48 and 50 comprise generally cylindrical members having circumferential grooves fromed near each end and are mounted within base member 36 by placing the circumferential groove at the first end thereof within slot 52 in base member 36. The second end of piston members 48 and 50 are contained within separate cylindrical chambers 54 within pad member 42. Seal 56, which can be any suitable fluid occlusive seal, is mounted on each piston in the circumferential groove formed near the second end of each, forming a fluid isolated chamber at atmospheric pressure within the lower portion of chambers 54 below each piston member. As will become apparent from the description of the operation of the contact pad member 32, seal 56 will change from a dynamic seal to a static seal when pad member 42 is set. First and second pad protection members 58 and 60 are mounted by suitable means, such as screws 62, to body member 22 and extend outwardly therefrom beyond the face of pad member 42 when pad member 42 is in a retracted positon.

In operation of the centralizing/retaining apparatus 20, the apparatus is installed at locations along the measurement while drilling assembly and affixed at each end by threaded couplings 28. The compressed air within chambers 54 serves to keep pad member 42 in a retracted position for insertion of the assembly into drill collar section 18. The measurement-while-drilling-instrument is inserted within the drill collar section 18 and pressure is applied to the annulus between the MWD tool and the drill collar. As pressure increases in the drill collar annulus pad member 42 will slide along guide shaft 44, pistons 48 and 50, and inclined surface 40 causing the face of pad member 42 to extend beyond members 58 and 60 and into contact with the inner surface of drill collar section 18. The wedging action provided by the inclined plane increases the mechanical holding force of contact pad member 32. Typically this initial operation to set the measurement-while-drilling-instrument within drill collar section 18 will be conducted prior to shipping of the measurement while drilling system to a field location.

At the drilling location drill collar section 18 including the measurement-while-drilling system therein is attached in drill string 10 at a location above drill bit 16 and the entire assembly is inserted within borehole 12. As drill string traverses into borehole 12 the hydrostatic pressure increases. This increase in pressure will cause pad member 42 to remain firmly set against the inner wall of drill collar section 18 throughout the drilling operation. To protect pad member 42 from wear caused by mud flow, member 58 had a generally triangular configuration which will divert flow away from pad member 42 thereby reducing wear.

Upon removal of the measurement while drilling system from borehole 12 using the present invention the system can be removed efficiently from drill collar section 18. A longitudinal force is applied to the measurement while drilling instrument and thus body member 22. This force acting in conjunction with the compressed air contained in chambers 54 will cause pad member 42 to slide down guide shaft 44, pistons 48 and 50 and inclined plane surface 40 thereby releasing the face from contact with the inside of drill collar section 18 and allowing the instrument to be removed.

Accordingly, it should be clearly understood the form of the invention described and illustrated herein is exemplary only, and is not intended as a limitation on the scope of the present invention.

The embodiments of the invention in which an exclusive property or privilege is claimed are defined as follows:

1. Apparatus for mounting an instrument within a tubular member comprising:

an elongated body member for attachment to said instrument;

a plurality of fixed contact pad members mounted to said body member; and a pressure responsive slidable contact pad member mounted to said body member, said pressure responsive contact pad member responsive to a pressure increase within the annulus of said tubular member, said pressure responsive contact pad member comprising a base member rigidly mounted to said body member said base member having an inclined plane surface and a generally wedge shaped contact pad member slidably retained within said base member for translational movement along said inclined plane surface for radial displacement of said wedged shaped contact pad member.

2. The apparatus of claim 1 wherein said contact pad member further comprises a truncated generally wedged shaped contact pad.

3. The apparatus of claim 2 wherein said contact pad member further comprises a contact pad member having at least one atmospheric pressure chamber formed therein.

4. The apparatus of claim 3 wherein said slidable contact pad member further comprises:

at least one stationery piston member having a first end mounted to said base member and a second end retained within said chamber of said contact pad member; and seal means proximate said second end of said piston member whereby an atmospheric chamber is formed within said contact pad member.

5. Apparatus for mounting and centralizing a measurement while drilling instrument within a protective drill collar comprising:

an elongated body member adapted for attachment to said measurement while drilling instrument;

a plurality of fixed contact pad members mounted to said body member;

a base member having an inclined plane mounted to said body member; and a differential pressure responsive contact pad member slidably retained within said base member, said pad member having at least one atmospheric pressure chamber formed therein wherein said pressure responsive contact pad member is displaced along inclined plane in contact with said drill collar in response to the pressure differential between said atmospheric pressure chamber and hydrostatic pressure.

6. The apparatus of claim 5 further comprising:

at least one stationery piston member having a first end mounted to said base member and a second end within said chamber; and seal means near the second end of said piston member.

7. The apparatus of claim 6 further comprising a guide shaft having both ends thereof mounted to said base member, said pad member slidable on said shaft.

8. The apparatus of claim 7 wherein said contact pad further comprises a generally edged shaped member.

* * * * *